United States Patent [19]

Förster et al.

[11] Patent Number: 4,531,908

[45] Date of Patent: Jul. 30, 1985

[54] CERAMIC BURNER HEAD

[75] Inventors: Siegfried Förster, Alsdorf; Stefan R. Schindler; Hartmut Keller, both of Selb, all of Fed. Rep. of Germany

[73] Assignees: Kernforschungsanlage Julich GmbH, Julich; Rosenthal Technik AG, Selb, both of Fed. Rep. of Germany

[21] Appl. No.: 398,797

[22] Filed: Jul. 16, 1982

Related U.S. Application Data

[63] Continuation of Ser. No. 250,768, Apr. 3, 1981, abandoned.

[30] Foreign Application Priority Data

Apr. 11, 1980 [DE] Fed. Rep. of Germany ..... 3014059

[51] Int. Cl.[3] ..... F23D 11/44

[52] U.S. Cl. ..... 431/215; 431/181; 165/166; 239/418; 239/555; 432/223

[58] Field of Search ..... 431/328, 171, 215, 181, 431/354, 216; 165/166; 239/418, 555; 432/223

[56] References Cited

U.S. PATENT DOCUMENTS

| | | | |
|---|---|---|---|
| 742,879 | 11/1903 | Lawler | 431/328 |
| 3,635,651 | 1/1972 | Desty | 431/328 |
| 3,650,661 | 3/1972 | Laguinia | 431/328 |
| 3,922,136 | 11/1975 | Koch | 431/328 |
| 4,364,726 | 12/1982 | Förster et al. . | |
| 4,376,627 | 3/1983 | Forster et al. | 431/328 |

FOREIGN PATENT DOCUMENTS 2740537 3/1978 Fed. Rep. of Germany .

*Primary Examiner*—Henry Bennett

*Attorney, Agent, or Firm*—Karl F. Ross; Herbert Dubno

[57] ABSTRACT

A ceramic burner head in which the burner mouth is formed from a unitary porous ceramic body with parallel slits defining fuel-permeable walls between and which is bonded to upper, lower and lateral ceramic plates forming the burner body. The ceramic piece is bonded to the plates in a gas-tight manner.

1 Claim, 5 Drawing Figures

CERAMIC BURNER HEAD

This is a continuation of application Ser. No. 250,768, filed Apr. 3, 1981, now abandoned.

CROSS REFERENCE TO RELATED APPLICATIONS

The present application is related to the commonly owned copending applications Ser. No. 100,634 filed Dec. 5, 1979 now U.S. Pat. No. 4,364,726 and Ser. No. 134,797 filed Mar. 28, 1980 now U.S. Pat. No. 4,376,627

FIELD OF THE INVENTION

Our present invention relates to a burner head and, more particularly, to a ceramic burner head in which the oxygen-carrying gas or oxidizing agent and the fuel are mixed at least in part by diffusion of the fuel or permeation of the fuel through porous walls.

BACKGROUND OF THE INVENTION

There are many systems designed to bring intimate mixture of the oxidizing agent, i.e. an oxygen-carrying gas such as air, and a fuel fluid, generally a liquid or gaseous hydrocarbon, prior to discharge of the resulting combustible mixture from a burner mouth. Some of these systems have been discussed in greater detail in the above-identified applications, which are hereby incorporated in their entirety by reference.

The present invention is an improvement over ceramic burner heads of the type described particularly in application Ser. No. 134,797 in which the burner head is formed over the entire length of the ceramic body, which is generally of rectangular parallelepipedal configuration, with mutually parallel slit-like flow passages for the fuel and oxidizing agent and in which the passages for the fuel alternate with those of the oxidizing agent and the passages for the different fluids are separated from one another by partitions which are composed of fluid-permeable porous material.

Ceramic burner heads of this type can be introduced individually or in stacks or arrays, in furnaces and other heating installations of small capacity or in large-capacity industrial furnaces and are suitable for use with gaseous and liquid fuels.

As described in the application Ser. No. 134,797, now U.S. Pat. No. 4,376,627, at least for liquid fuels, it is advantageous to preheat the oxidizing agent by indirect heat exchange with furnace exhaust gases, and then to effect a further heat exchange between the oxidizing agent and the liquid fuel in the flow passages of the ceramic body.

The liquid fuel penetrates the porous walls between the flow passages in the region of the burner mouth and is entrained by the combustion air which has been preheated in the manner described. Because the fuel evaporates on or in the porous walls and the high effective surface area thereof in a rapid manner and because of the cooling effect of the evaporation, an overheating of the fuel, which could lead to cracking, cannot occur. In the air passages, the air and the fuel mix and the resulting ignitable mixture is discharged.

OBJECTS OF THE INVENTION

It is the principal object of the present invention to extend the principles of the above-mentioned copending applications.

Another object of the invention is to simplifiy the construction of a ceramic burner head operating under the principles of the burner head application Ser. No. 134,797 now U.S. Pat. No. 4,376,627.

Yet another object of the invention is to provide a burner head which eliminates the drawbacks of earlier systems as described in the aforementioned copending application and provides improved fuel combustion with a simple and economical structure.

SUMMARY OF THE INVENTION

These objects and others which will become apparent hereinafter are attained in a burner head having slit-shaped, mutually parallel flow passages alternating for the fuel and oxidizing agent and separated by walls or partitions which are fluid permeable and porous in the manner described and in which the passages are formed at the burner mouth by a porous fluid-permeable body which is flanked by fluid-impermeable outer walls along its entire perimeter and which is embedded and hermetically sealed to these walls, in the form of ceramic plates.

According to the invention, the burner body is a rectangular parallelepipedal structure formed with these plates over the entire length of the burner and includes slit-like passages which alternate with one another and respectively conduct the oxidizing agent, i.e. combustion air, and furnace exhaust gas in counter-flow to one another to preheat the combustion air. These combustion air passages according to the invention, terminate at a distance from the combustion air passages of the porous body, the space between them forming, within the aforementioned walls, a flow equalization or distribution chamber whereby the preheated oxidizing agent is distributed to the air flow passages of the porous body.

Thus, by contrast to the earlier systems described, the burner can be formed with a porous body only at the burner mouth and the porous body can be single piece unitary structure which, however, does not pose problems because it is flanked on all of its peripheral sides by the impermeable walls to which it is bonded in a gas-tight manner.

The porous body, moreover, can be made independently from the passage-forming body which defines the air and exhaust gas passages in the heat exchanger portion of the body and because of the independently construction of these two elements, both the heat exchanger portion and the burner mouth with its porous body can be made to suit the desired combustion conditions or the heat exchange capacity which may be necessary.

Furthermore, the spacing enables the passages of the heat exchanger body to be of different size and of greater or lesser number than the passages of the porous body and vice versa while ensuring uniform distribution of the air to the passages of the porous body.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
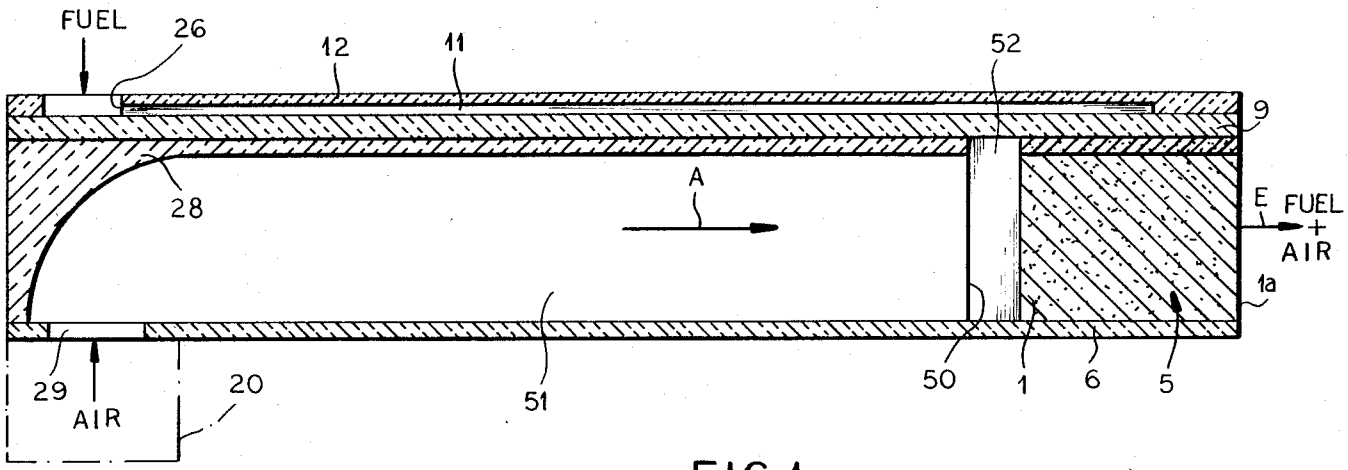
FIG. 1 is a vertical section through a burner head embodying the invention.

From the diagrammatic illustration of the drawing it will be apparent that the burner head of the invention is formed in the region of its mouth 3 with slit-shaped flow passages 1 and 2 for the oxidizing agent and fuel.

In the construction illustrated, the passages 1 carry preheated combustion air while the passages 2 are supplied with gaseous or liquid fuel.

The passages 2 are closed at the burner mouth 3 by pieces 4.

The slits are defined by a unitary ceramic body or mouthpiece 5 which is composed entirely of gas-permeable porous ceramic material, this body being flanked by gas-tight or impermeable plates 6, 7, 8 and 9 which define outer walls of the burner mouth.

Figure 5:
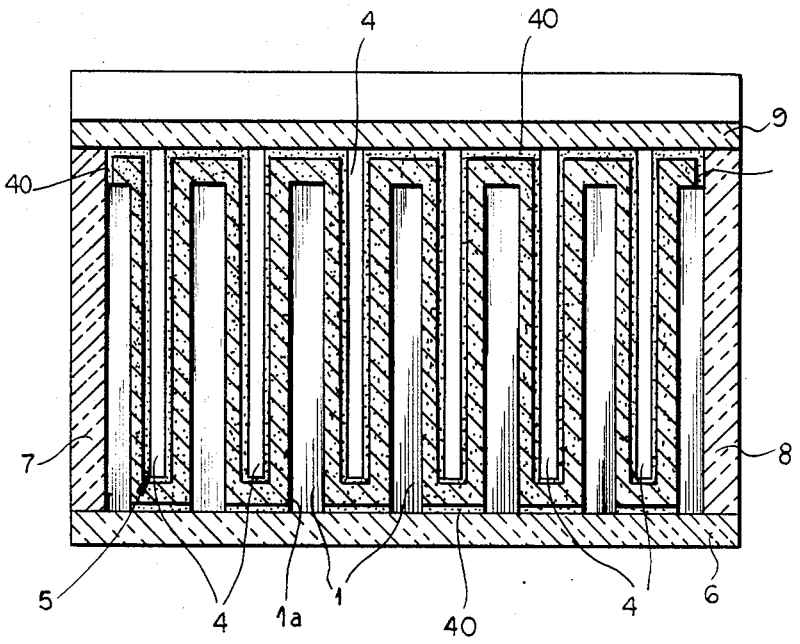
FIG. 5 is an end view of the burner.

As can be seen from FIG. 5, the outer surfaces of the ceramic body 5 can be coated with a layer 40 of a refractory cement, placed within the plates 6–9 and the assembly fired to effect the hermetic seal.

The gas/fuel mixture is discharged through the windows 1*a* shown in FIG. 5 and at which the slits terminate at the mouth 3 of the burner head.

Figure 2:
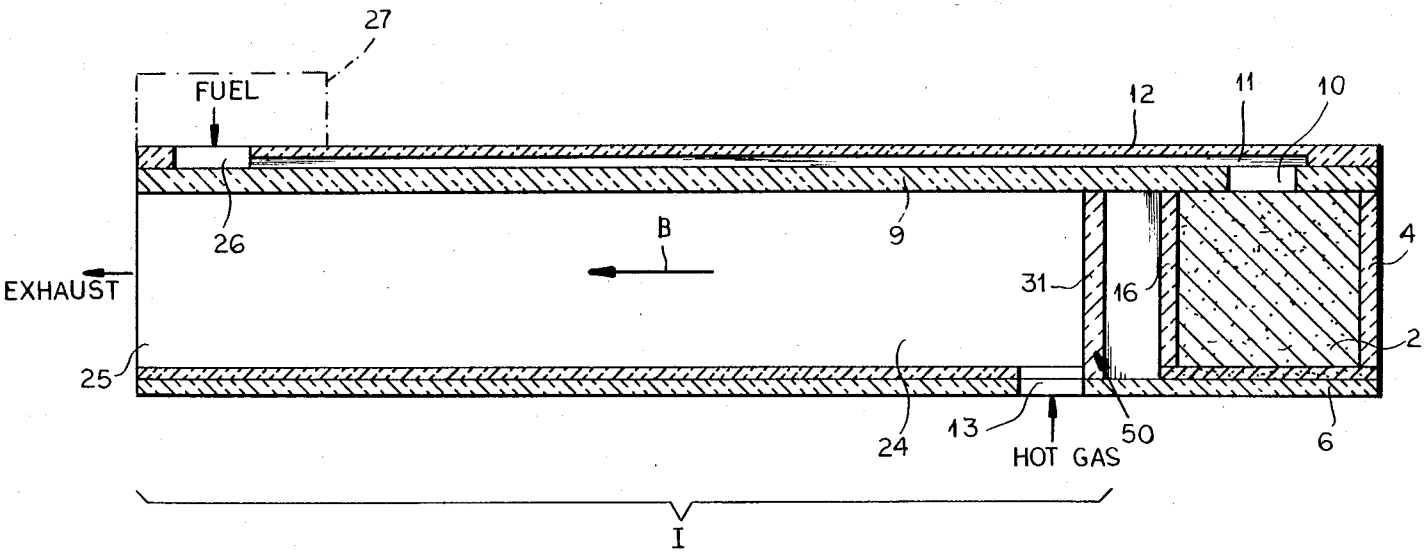
FIG. 2 is a similar section taken through the burner head but cutting through the exhaust gas channels thereof.
Figure 3:
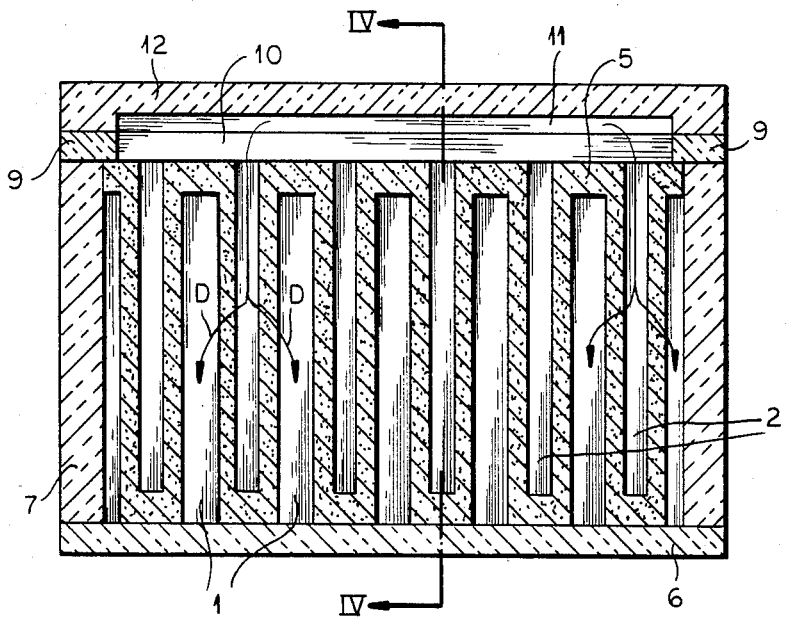
FIG. 3 is a detail view of the burner head drawn to a larger scale and taken in section along the line III—III of FIG. 4.

The plate 9 is formed with an elongated slot 10 extending across the width of the burner mouth 3, for distributing fuel to the slots 2, the fuel being delivered by a passage 11 defined between a cover plate 12 and the plate 9. The fuel can be admitted through an appropriate fitting 27 and a bore 26 in the plate 12 (FIG. 2).

Figure 4:
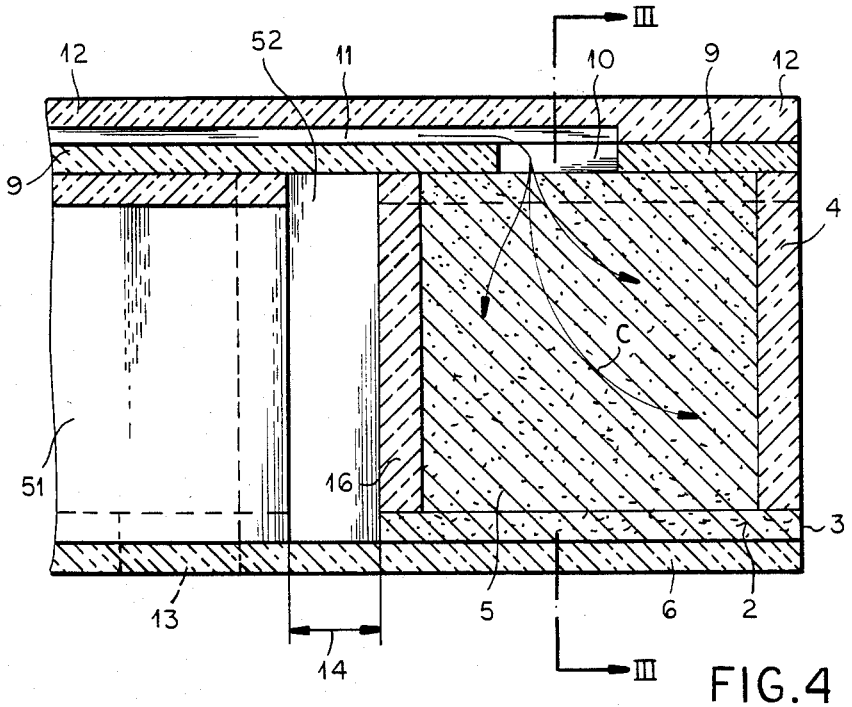
FIG. 4 is a detail view corresponding to a section along the line IV—IV of FIG. 3.

Combustion air is delivered to the passages 1 through slit-like passages 51 (FIGS. 1 and 4) and can be supplied by a fitting 20 connecting these passages to a source of compressed air or a blower, the air being admitted to the slits 51 through openings 29 in the plate 6 (FIG. 1). The slits 51 are formed in a ceramic body 50 which need not be composed of fluid-permeable material and are closed at 28, remote from the burner mouth so that the air flows in the direction of arrow A toward the mouthpiece 5 and a compartment 52.

The slits 51 alternate with slits 24 of the ceramic body 50, the slits 24 being closed by walls 31 at the end of the body 50 proximal to the mouth but being open at 25 at their opposite ends.

Hot exhaust gas is admitted through openings 13 to the slits 24 and flows in the direction of arrow B through the body.

As a comparison of FIGS. 1 and 2 will show, the portion I of the burner head rearwardly of the mouth 3 forms a counterflow heat exchanger in which the combustion air is preheated by the exhaust gas indire y and in counterflow.

The mouthpiece 5 is spaced from the ends of the l w passages 51 by a distance 14 which is a multiple of e width of the slits 51 so that the compartment 52 se s to effect pressure and flow equalization and distribu n of the air to the passages 1.

The passages 2 are closed off from the compartr t 52 by walls 16 which are set in place like the wal . Thus, the fuel enters the passages 2 in the directio f arrows C and permits through the walls in the direc n of arrows D to mix with the air in the passages 1. e fuel/air mixture emerging in the direction of arrov . The mixture can be ignited as described in applica n Ser. No. 134,797 now U.S. Pat. No. 4,376,627.

Naturally, once the slip 40 has been fired, the b d between member 5, plates 6 through 9 and the piec 4 and 16 is an impermeable ceramic bond.

We claim:

1. A ceramic burner head formed with a bu r mouth and comprising:

a unitary fluid-permeable porous ceramic bod f rectangular parallelepipedal configuration te i- nating at said mouth and formed with mutu y parallel alternating slit-like flow passages for l and air whereby fuel from the fuel passages p - trates through porous walls formed between d passages by said body to mix with said air, and o formed with impermeable outer walls peripher y flanking said body and hermetically sealed ther , said flow passages being closed off from d mouth, each of said slit-like passages for said r having a height substantially equal to that of d mouth and a width which is small relative to s height and opening at said mouth;

a ceramic heat exchange rectangular parallelepip l member spaced from said body to define a fl - distributing compartment therewith opening o said air passages, said member being provided h slit-shaped passages for said air opening into d compartment and effecting heat exchange betw n said air and a heat exchange fluid traversing fur r slit-shaped passages in said member alterna g with the slit-shaped passages of said air, eacl f said slit-shaped passages having a height subs - tially equal to that of said body and a width wl n is small relative to its height; and a pair of ceramic plates which extend the full ler n of said burner head and enclose both said body d said member, said plates forming said walls, on f said plates being formed with an inlet for said l and an opposing plate being provided with an i t for said air, said passages extending perpendic r to said one of said plates and said opposing pl , said plates delimiting said compartment directl

* * * * *